United States Patent [19]

Reed

[11] 4,054,122

[45] Oct. 18, 1977

[54] GAS HUMIDIFIER

[76] Inventor: Hugh T. Reed, 3067 Valwood Parkway, Farmers Branch, Tex. 75234

[21] Appl. No.: 615,359

[22] Filed: Sept. 22, 1975

[51] Int. Cl.[2] ..... F24F 3/14

[52] U.S. Cl. ..... 126/113

[58] Field of Search ..... 126/113; 261/DIG. 15

[56] References Cited

U.S. PATENT DOCUMENTS

| | | | |
|---|---|---|---|
| 2,059,408 | 11/1936 | Stark | 126/113 X |
| 2,133,599 | 10/1938 | Turney | 126/113 X |
| 3,215,416 | 11/1965 | Liben | 126/113 X |
| 3,294,081 | 12/1966 | Zach | 126/113 |

*Primary Examiner*—Robert G. Nilson

*Attorney, Agent, or Firm*—Richards, Harris & Medlock

[57] ABSTRACT

The specification discloses a humidifier for connection to a hot gas furnace having gas burners for heating air to be discharged through a plenum chamber and having a hot waste gas vent pipe for venting heated waste gas. The humidifier includes a housing which is substituted for a section of the hot waste gas vent pipe. A coil is disposed within the housing for directing water through the hot waste gas vent pipe so that the coil is heated from ambient temperature to a predetermined operating temperature by the waste gas thereby vaporizing the water into steam. The coil material has a substantial coefficient of thermal expansion so that the coil substantially expands and contracts as its temperature changes thereby separating sediment from the interior thereof. The coil has an inside dimension larger than the cross-sectional dimension of the vent pipe so that the flow of hot gases through the housing is not inhibited by the coil. Fluid from the water receiving coil, together with any sediment carried thereby, is separated in a sediment separation zone. A drain extending into the sediment separation zone periodically removes excess liquid accumulating therein. A control is provided for permitting the flow of water into the coil for a preset time after heated waste gas has ceased being vented through the waste gas vent pipe so that the coil is cooled and sediment flushed therefrom.

5 Claims, 3 Drawing Figures

GAS HUMIDIFIER

BACKGROUND OF THE INVENTION

1. Field of the Invention

This invention relates to a humidifying system, and more particularly to a humidifier which uses the heat of waste gas from a gas furnace to produce steam and which automatically flushes sediment from the steam generating apparatus.

2. Prior Art

A most significant disadvantage in heating systems presently used in buildings and homes is their inability to provide and maintain a desirable humidity level in the areas being heated. Although several approaches have been devised with the objective of introducing water vapor into the environment, such approaches have generally been characterized by an inability to accurately produce a predetermined humidity level and to maintain such level over extended periods of time without continual attention, adjustment and expense. A type of apparatus heretofore used includes the utilization of a coil within the waste gas or vent pipe of a heating unit wherein heat from such gases is utilized to vaporize water which has been injected into the heated air stream produced by the heating unit. Such coil type apparatus have proven generally unsatisfactory because the coil itself poses an obstacle within the vent pipe and thereby restricts the free flow of waste gas from the furnace. Furthermore, such coil type humidifers have not been capable of accurately introducing a desired quantity of humidity into the environment or maintaining a predetermined humidity level.

An additional problem experienced in the operation of these devices is that the coil tends to become clogged with sediment resulting from the evaporation process, therefore necessitating regular cleaning of the coil in order to assure efficient operation. The systems have also been inefficient in sufficiently vaporizing the fluid sprayed into the moving air stream projected from the furnace and thus tend to pass bacteria and other potentially harmful microorganisms in the water directly into the air stream. This aspect of presently used units is particularly undesirable when used in hospitals, nursing homes and similar applications.

SUMMARY OF THE INVENTION

The present invention provides a system for overcoming the disadvantage found in the prior art and specifically provides an economical system for providing moisture for injection into the air stream generated by a gas furnace and for a system for self-cleaning sediment and other deposits which otherwise would tend to accumulate in the humidifying system. Further, the present system provides for the controlled vaporization of water for adding humidity to the atmosphere and for sufficiently vaporizing the water to kill bacteria and other microorganisms entering the humidifier with the water.

In accordance with the broader aspect of the present invention, a humidifier is provided for connection to a hot gas furnace having gas burners for heating air to be discharged through a plenum chamber and having a hot waste gas vent pipe for venting heated waste gas. The humidifier includes a tubular humidifier housing which is substituted for a section of the hot waste gas vent pipe such that heated air passing through the vent pipe also passes through the humidifier housing. A water coil is coaxially disposed within the tubular humidifier housing and directs water through the hot waste gas passing therethrough. The coil is heated from ambient temperature to a predetermined operating temperature by the movement of the heated waste gas, and the water within the pipe is vaporized into steam. The water coil has a cross-sectional dimension larger than the cross-sectional dimension of the vent pipe so that the flow of hot gases through the housing is not inhibited by the water coil.

The humidifier further includes a sediment separation zone with an upper and lower portion. Fluid flowing through the water coil is discharged into the upper portion of the sediment separation zone such that sediment and unvaporized water flowing from the coil are separated from steam by the action of gravity and collected in the lower portion of the sediment separation zone. Steam is discharged from the upper portion of the sediment separation zone and communicated into the plenum chamber of the furnace where the steam increases the humidity of the heated air generated by the furnace.

In accordance with another aspect of the invention, the water coil is formed from a material having a substantial coefficient of thermal expansion between ambient temperature and a predetermined operating temperature. As a result, the coil substantially expands as its temperature increases from ambient temperature to the predetermined operating temperature by the flow of waste gas through the vent pipe. The water coil likewise substantially contracts as the temperature of the coil is subsequently reduced when the furnace burners are shut off and the heated waste gas is no longer flowing through the vent pipe. The expansion and contraction of the water coil causes separation of sediment from the interior of the coil, and the sediment is carried out of the coil by the flow of fluids therethrough.

In accordance with still another aspect of the invention, the inlet end of the water coil is disposed below the steam outlet end of the coil. The flow of water into the coil is regulated such that upon heating the coil, primarily vaporized water is expelled from the upper outlet end of the coil.

In accordance with still another aspect of the invention, the sediment separation zone includes a drain mounted in the lower portion thereof and a siphon tube responsive to the accumulation of a predetermined quantity of liquid in the lower portion of the sediment separation zone for automatically siphoning the quantity of liquid therein to a predetermined lower level. In this way, unvaporized water discharged from the water coil into the sediment separation zone is not allowed to rise above a predetermined level within the sediment separation zone. Similarly, both sediment and water within the sediment separation zone may be cleaned therefrom through the drain provided within the separation zone.

In accordance with still another aspect of the invention, a solenoid valve is connected to the inlet tube of the water coil and controls the flow of water into the coil. A humidistat is operatively connected to the solenoid valve for controlling the solenoid valve and the injection of water into the coil when the humidity drops below a predetermined level.

An override control mechanism is further provided for preventing the actuation of the solenoid valve and the flow of water into the coil when the gas burners within the furnace are turned off. This shut-off mechanism merely stops the flow of water through the water coil at a period when no heated waste gas is being vented through the gas vent pipe and humidifier housing.

In accordance with still another aspect of the invention, circuitry is provided for actuating the solenoid valve to permit the continued flow of water through the water coil for a predetermined time after the burners have been cut off. In this way, any sediment dislodged from the water coil due to contraction resulting from cooling thereof may be flushed from the coil by the flow of water therethrough. Thus, the system incorporates an effective automatic system for cleaning the water coil of any sediment which may be deposited therein.

DESCRIPTION OF THE DRAWINGS

A more complete understanding of the invention may be had by referring to the following detailed description when taken in conjunction with the accompanying drawings, wherein.

DESCRIPTION OF THE PREFERRED EMBODIMENTS

Figure 1:
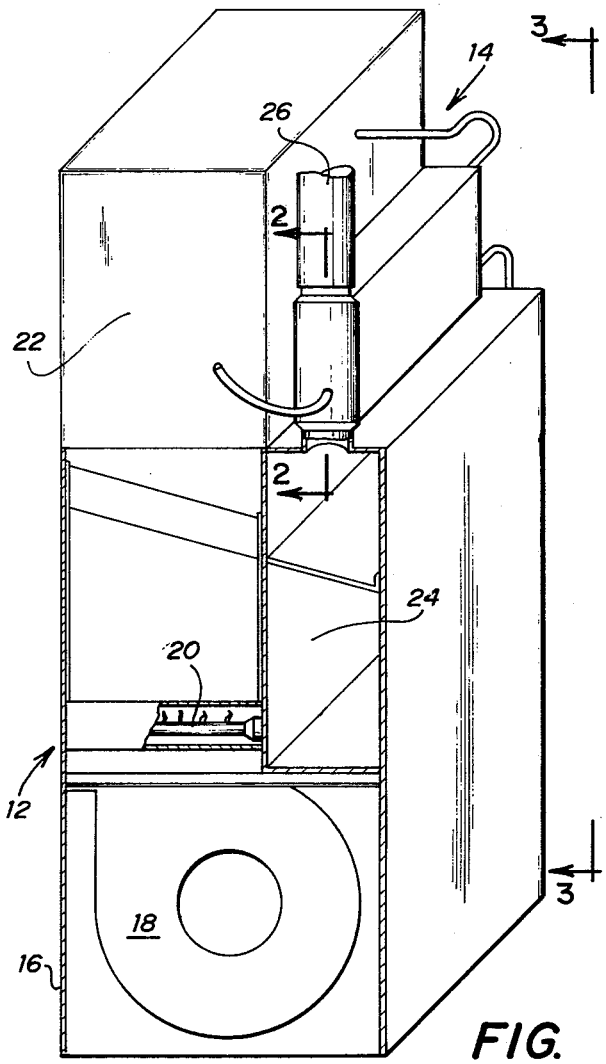
FIG. 1 illustrates in perspective view a conventional gas-fired furnace adapted with the humidifying system of the present invention.

FIG. 1 illustrates a conventional hot air furnace, indicated generally by the reference numeral 12, and adapted with the humidifying system of the present invention, identified generally by the reference numeral 14. The hot air furnace 12 includes a housing 16 enclosing a blower unit 18, for conveying heat from burners 20 to a plenum chamber 22. Adjacent to burners 20 and in draft communicating relation thereto is combustion gas chamber 24 for conveying waste combustion gases from the furnace to an outlet. The outlet is provided in the form of a vent pipe 26 which extends from gas chamber 24 to the atmosphere outside the building being heated by the furnace. Humidifying system 14 of the present invention is positioned in the flow channel of gases passing from gas chamber 24 through vent pipe 26 and is substituted for a portion of vent pipe 26. It will be readily recognized that humidfying system 14, and its internal associated apparatus, may be easily installed in existing furnace structures by simply removing an appropriate length of vent pipe 26 and inserting therein humidifying system 14.

Figure 2:
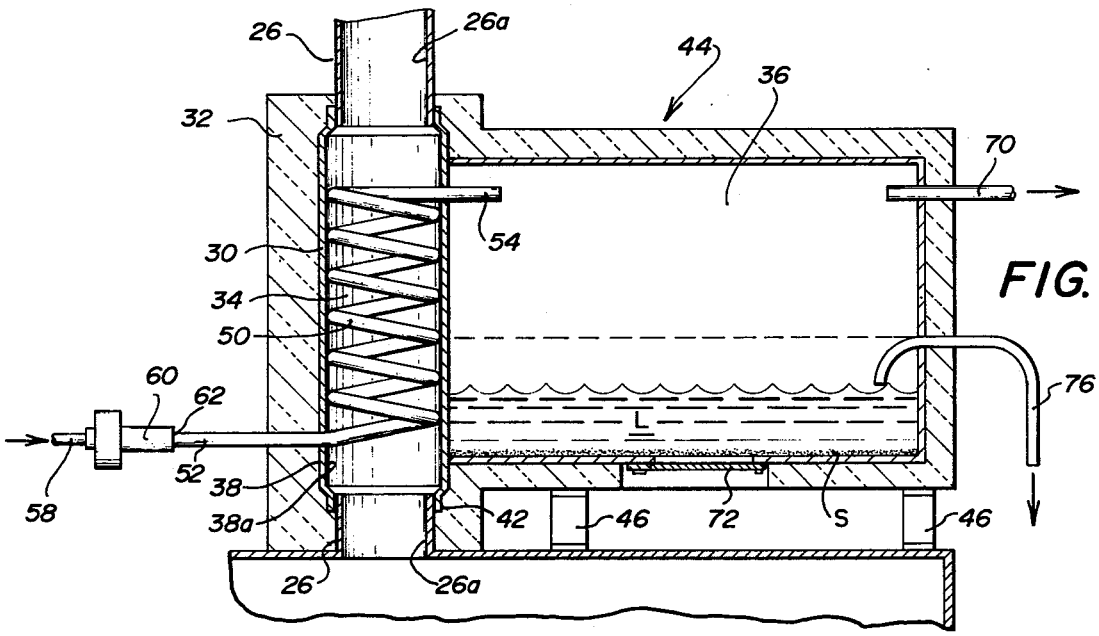
FIG. 2 is an enlarged sectional view taken along lines 2—2 in FIG. 1 and showing the humidifying system of the present invention.

Referring to FIG. 2, humidifying system 14 includes a housing 30 which may be formed from a corrosion sheet metal material, such as galvanized steel, stainless steel, aluminum, brass or the like. Alternatively, housing 30 may be formed from one of the various plastic materials which is stable at temperatures up to approximately 500° F. Housing 30 may be provided with an outer covering 32 formed from a thermal insulated material, if desired.

Housing 30 is partitioned to define two separate areas, a steam generation zone 34 and a sediment separation zone 36. In the illustrated embodiment of the invention shown in FIG. 2, the steam generation zone 34 is an elongated pipe 38 having an internal diameter **38*a* somewhat larger than the internal diameter 26*a* of pipe 26. Pipe 38 is tapered at both ends such that its upper end 40 may be inserted within pipe 26 and its lower end 42 may be positioned over the section of pipe 26 extending from gas chamber 24**.

Sediment separation zone 36 is a chamber 44 attached to pipe 38 which defines steam generation zone 34 and forms one of the sides of sediment separation zone 36. Chamber 44 is supported by attachment to pipe 38 and by legs 46 extending from furnace housing 16. While the illustrated embodiment of the invention depicts a common wall between steam generation zone 34 and sediment separation zone 36, practice of the invention is not dependent thereon, and steam generation zone 34 and sediment separation zone 36 may be formed as independent containers.

Disposed within pipe 38 is a water receiving/steam generating coil 50. Coil 50 extends from an inlet end 52 through steam generation zone 34 to an outlet end 54 which communicates with the upper portion of sediment separation zone 36. Coil 50 is characterized by inlet end 52 being disposed below outlet end 54. Water is introduced into inlet end 52 for passage through coil 50 where it is heated by the waste gases emanating from burners 20 through gas chamber 24. In order to enhance passage of such heated waste gases through steam generation zone 34 defined by pipe 38, coil 50 is not disposed directly within the gas flow path in the pipe. Instead, coil 50 is permissibly recessed in pipe 38 by reason of its inside diameter which is larger than that of vent pipe 26. Thus, the possibility of dangerous backup of combustion waste gases into plenum chamber 22 is substantially reduced, without detracting in any way from the heating of coil 50.

As is best shown in FIG. 2, the inlet end 52 of coil 50 operatively communicates with a water supply line 58. Water is received in inlet end 52 from supply line 58 through a solenoid controlled valve 60 and an orifice 62. Valve 60 is operated to selectively permit or prevent water flow into coil 50, while orifice 62 functions to regulate the water flow through coil 50. As the water flows through coil 50 in the steam generation zone 34, it is vaporized into steam, and the resulting steam is discharged into sediment separation zone 36 through outlet end 54 of coil 50

Coil 50 is formed from a material having a substantial coefficient of thermal expansion in the temperature range extending between ambient temperature (approximately 75° F.) and a predetermined operating temperature for humidifying system 14 (approximately 300°–400° F.). For example, coil 50 may be formed from aluminum. Because of its coefficient of thermal expansion, coil 50 substantially expands as the temperature in the steam generation zone is raised from the ambient temperature to the operating temperature, and substantially contracts as the temperature within the steam generation zone 34 is subsequently reduced from the operating temperature to the ambient temperature. Such expansions and contractions of coil 50 function to dislodge any sediment that may have accumulated therein. The sediment in turn is carried through coil 50 and is discharged from outlet end 54 with the fluid flowing through the coil.

Outlet end 54 of coil 50 emerges from steam generation zone 34 through the wall of pipe 38 at a relative position higher than inlet end 52. Such relative positioning of the ends of coil 50 reduces the possibility of water emerging from outlet end 54, as water will have to boil upwardly against forces of gravity to be expelled through outlet end 54. Additionally, quantitative metering of water at orifice 62 is controlled such that the amount of unvaporized water expelled from coil 50 is held to a minimum. Therefore, more effective and complete vaporization of water into steam is achieved.

In operation of humidifier system 14, fluid flowing through coil 50 is discharged into the upper portion of the sediment separation zone 36. This fluid is normally entirely comprised of steam, but may also include small amounts of unvaporized water. Also, any sediment dislodged from the interior of coil 50 due to the expansion and contraction thereof, or otherwise, is carried through coil 50 by the fluid flowing therein. All of these materials are discharged into the upper portion of sediment zone 36 through outlet end 54 of coil 50.

Steam flowing into the upper portion of sediment separation zone 36 is immediately discharged therefrom through an outlet 70. Unvaporized water entering sediment separation zone 36 accumulates in the lower portion thereof under the action of gravity to define a quantity of liquid L. Sediment received in sediment separation zone 36 through outlet end 54 accumulates in the lower portion thereof under the action of gravity to form a sediment layer S. The sediment and water collected in separation zone 36 may be cleaned from the housing by means of a drain door 72.

Sediment separation zone 36 is provided with a drain apparatus 74 mounted in the lower portion of sediment separation zone 36. Drain apparatus 74 comprises a tube 76 having an inverted U-shaped configuration. By means of this configuration, drain apparatus 74 functions as a siphon. That is, when the level of the quantity of liquid L accumulating in the lower portion of sediment separation zone 36 rises to the plane approximately indicated by the dashed line in FIG. 2, drain apparatus 74 automatically functions to siphon the liquid out of the lower portion of sediment zone 36. This siphoning action continues until the level of the quantity of liquid L from the lower portion of sediment separation zone 36 is reduced to the plane approximately indicated by the solid line in FIG. 2.

Figure 3:
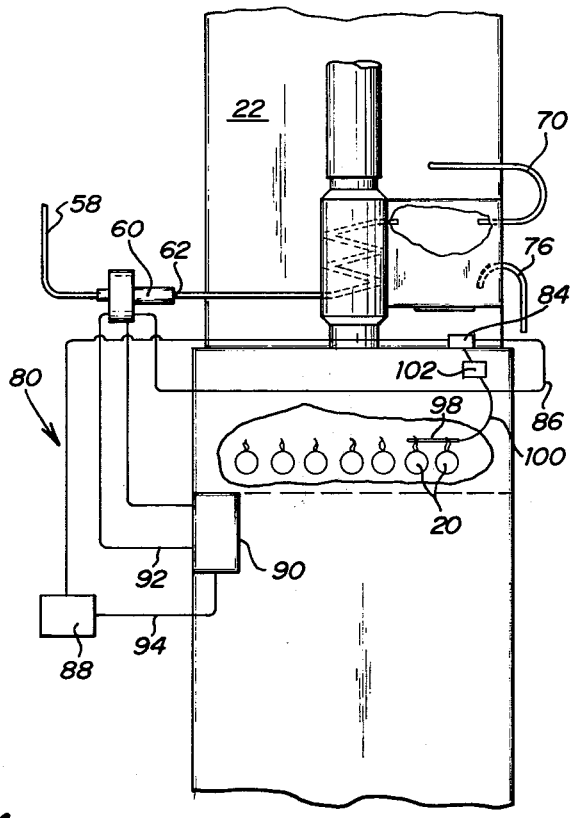
FIG. 3 illustrates a front view of the system shown in FIG. 1 with the control circuitry used in the present invention.

FIG. 3 illustrates an electrical control circuit 80 utilized in humidifier system 14 to selectively actuate the solenoid control valve 60 and thereby regulate the flow of water into coil 50. Solenoid valve 60 is actuated by switch 84 through electrical conduit 86 extending from solenoid 60 to humidistat 88. Voltage is supplied to solenoid valve 60 from transformer 90 by way of conduit 92. Transformer 90 is similarly electrically connected to humidistat 88 by way of conduit 94 to thereby complete a closed circuit control for operation of the humidifier system.

Whenever the humidistat 88 indicates that the humidity has dropped below a predetermined level, a signal is applied through switch 84 to solenoid valve 60 which permits water to flow from supply line 58 into coil 50 connected thereto. The rate of water flow into coil 50 is regulated by orifice 62. Switch 84 is connected to operate only when burners 20 are in operation as it is only during the operation of burners 20 that sufficient waste gas heat is available to convert water in coil 50 into steam.

It will be understood that the actuation of switch 84 permitting the flow of water from supply line 58 into coil 50 and the ignition of burners 20 will in some instances occur simultaneously. In this case, the temperature within steam generation zone 34 initially will not be sufficient to cause vaporization of water flowing through coil 50 into steam. This arrangement is advantageous in that the water flowing through coil 50 during the initial phase of the operation of humidifier system 14 tends to clear sediment out of coil 50 which may have been dislodged during the previous contraction thereof. Moreover, as the temperature within steam generation zone 34 rises, additional sediment may be dislodged, and this sediment is also carried out of coil 50 by the water flowing therethrough.

As the temperature in steam generation zone 34 increases to the operating temperature, the water flowig through coil 50 is vaporized and is discharged from outlet end 54 in the form of steam. It has been found that waste gases from gas-fired furnaces provide an operating temperature in the range of 300° F. The relatively high operating temperature of humidifier system 14 functions to kill any bacteria or other microorganisms which might enter coil 50 with the water flowing therethrough. Therefore, the steam discharged from outlet end 54 is substantially free of such oganisms. This steam in turn discharged from sediment separation zone 36 through outlet 70 into plenum chamber 22 where the steam mixes with heated air from furnace 12. The humidified air is therefore transmitted to various rooms by the heating ducts normally used in carrying heat from the furnace.

When the humidity reaches a preselected level, the input signal provided by humidistat 88 is removed from switch 84. As a result, solenoid, valve 60 is closed and the supply of water from supply line 58 to coil 50 is cut off. Switch 84 is also controlled by burners 20 through sensor 98 interconnected between burners 20 and switch 84 by line 100 such that when burners 20 shut off, the predetermined signal is removed from switch 84 and solenoid valve 60 prevents water from moving into coil 50 from supply line 58. the signal from sensor 98 is delayed by delay circuit 102 interconnected between sensor 98 and switch 84 along line 100, thereby maintaining solenoid valve 60 in an open condition for a preset period of time following the shutting down of burners 20. Because solenoid valve 60 is maintained in an open position, water continues to flow into coil 50 after the operation of burners 20. This is beneficial in reducing the temperature of coil 50 and also in flushing any dislodged sediment therefrom resulting from the cooling and contraction of coil 50. Also, as the temperature within the steam generation zone decreases from the predetermined operating temperature to the ambient temperature, coil 50 contracts causing additional sediment to be dislodged from the interior thereof. Any such additional sediment is also flushed from the interior of coil 50 under the action of water flowing therethrough.

Thus, the present humidifying system comprises a humidifier incorporating numerous advantages over the prior art. One important advantage in the present invention is the economy derived from the use of heated waste gases from a gas furnace to vaporize water for use in regulating the humidity in heated air generated by the furnace and for use in heating homes and offices. The present invention describes an economical and easily installed system for effectively utilizing such waste energy without adversely effecting the normal operation of the gas furnace unit. Another important advantage derived from the use of the present invention is the regulation of the humidity without the introduction of bacteria or other potentially harmful microorganisms into the atmosphere being controlled. Still another advantage of the present invention is that the humidifier system functions automatically to flush sediment from the interior of the steam generating apparatus during normal operation.

Whereas the present invention has been described with respect to the specific embodiments thereof, it will be understood that various changes and modifications will be suggested to one skilled in the art, and it is intended to encompass such changes and modifications as fall within the scope of the appended claims.

I claim:

1. A humidifier for connection to a hot gas furnace having a hot waste gas vent pipe of predetermined cross-sectional size for venting heated waste gas, comprising:

a humidifier housing, said housing being substituted for a section of the hot waste gas vent pipe, a water coil disposed in said humidifier housing for directing water through the hot waste gas vent pipe wherein the water is vaporized into steam, said coil being formed from a material having a coefficient of thermal expansion between ambient temperature and a predetermined operating temperature so that said coil substantially expands as the temperature of said coil is raised from ambient temperature to a predetermined operating temperature by the flow of waste gas through said vent pipe and substantially contracts as the temperature of said coil is subsequently reduced, the expansions and contractions of said coil causing separation of sediment from the interior thereof which sediment is carried through said coil by fluid flowing therethrough, a sediment separation zone having an upper and lower portion, means for discharging the fluid flowing through said coil into the upper portion of said sediment separation zone so that sediment and unvaporized water flowing from said coil are separated from steam by the action of gravity and collected in the lower portion of said sediment separation zone, means for discharging steam from the upper portion of said sediment separation zone, said humidifier housing is tubular and said water coil is coaxially disposed therein with an inside coil dimension larger than the cross-sectional dimension of the vent pipe so that the flow of hot gases through said housing is not inhibited by said water coil, and drain means mounted in the lower portion of said sediment separation zone and comprising siphon means responsive to the accumulation of a predetermined quantity of liquid in the lower portion of said sediment separation zone for automatically

2. A humidifier for connection to a hot gas furnace having a hot waste gas vent pipe of predetermined cross-sectional size for venting heated waste gas, comprising:

a humidifier housing, said housing being substituted for a section of the hot waste gas vent pipe, a water coil disposed in said humidifier housing for directing water through the hot waste gas vent pipe wherein the water is vaporized into steam, said coil being formed from a material having a coefficient of thermal expansion between ambient temperature and a predetermined operating temperature so that said coil substantially expands as the temperature of said coil is raised from ambient temperature to a predetermined operating temperature by the flow of waste gas through said vent pipe and substantially contracts as the temperature of said coil is subsequently reduced, the expansions and contractions of said coil causing separation of sediment from the interior thereof which sediment is carried through said coil by fluid flowing therethrough, a sediment separation zone having an upper and lower portion, means for discharging the fluid flowing through said coil into the upper portion of said sediment separation zone so that sediment and unvaporized water flowing from said coil are separated from steam by the action of gravity and collected in the lower portion of said sediment separation zone, means for discharging steam from the upper portion of said sediment separation zone, said humidifier housing is tubular and said water coil is coaxially disposed therein with an inside coil dimension larger than the cross-sectional dimension of the vent pipe so that the flow of hot gases through said housing is not inhibited by said water coil, and said hot waste gas vent pipe is disposed in substantially vertical position, said coil is characterized by a water inlet tube extending from the lower end of said coil and an outlet pipe extending from the upper end of said coil, means for regulating the rate of water flow into said coil such that water injected into the water inlet tube is maintained within said coil due to the action of gravity thereon until the water has been vaporized into steam and expelled through the outlet pipe, solenoid means connected to the inlet tube of said coil for controlling the flow of water into said coil, a humidistat operatively connected to said solenoid means for controlling said solenoid means and the injection of water into said coil wherein said hot waste gases vaporize the water into steam, an override control mechanism for preventing the actuation of said solenoid means and the flow of water into said coil when the gas burners within said furnace are turned off.

3. A humidifier for connection to a hot gas furnace having a hot waste gas vent pipe of predetermined cross-sectional size for venting heated waste gas, comprising:

a humidifier housing, said housing being substituted for a section of the hot waste gas vent pipe, a water coil disposed in said humidifier housing for directing water through the hot waste gas vent pipe wherein the water is vaporized into steam, said coil being formed from a material having a coefficient of thermal expansion between ambient temperature and a predetermined operating temperature so that said coil substantially expands as the temperature of said coil is raised from ambient temperatures to a predetermined operating temperature by the flow of waste gas through said vent pipe and substantially contracts as the temperature of said coil is substantially reduced, the expansions and contractions of said coil causing separation of sediment from the interior thereof which sediment is carried through said coil by fluid flowing therethrough, a sediment separation zone having an upper and lower portion, means for discharging the fluid flowing through said coil into the upper portion of said sediment separation zone so that sediment and unvaporized water flowing from said coil are separated from steam by the action of gravity and collected in the lower portion of said sediment separation zone, means for discharging steam from the upper portion of said sediment separation zone, said humidifier housing is tubular and said water coil is coaxially disposed therein with an inside coil dimension larger than the cross-sectional dimension of the vent pipe so that the flow of hot gases through said housing is not inhibited by said water coil, and said hot waste gas vent pipe is disposed in substantially vertical position, said coil is characterized by a water inlet tube extending from the lower end of said coil and an outlet pipe extending from the upper end of said coil, means for regulating the rate of water flow into said coil such that water injected into the water inlet tube is maintained within said coil due to the action of gravity thereon until the water has been vaporized into steam and expelled through the outlet pipe, solenoid means connected to the inlet tube of said coil for controlling the flow of water into said coil, a humidistat operatively connected to said solenoid means for controlling said solenoid means and the injection of water into said coil wherein said hot waste gases vaporize the water into steam, means for operating said solenoid means for continuing the flow of water through said coil for a predetermined time after the burners have been cut off to cool said coils thereby flushing sediment therefrom.

4. A humidifier for connection to a hot gas furnace having gas burners for heating air to be discharged through a plenum chamber and having a hot waste gas vent pipe for venting heated waste gas, comprising:

a humidifier housing, said housing being substituted for a section of the hot waste gas vent pipe, coil means disposed in said housing for directing water through the hot waste gas vent pipe wherein said coil means is heated from ambient temperature to a predetermined operating temperature by the waste gas thereby vaporizing the water into steam, said coil means being formed from a material having a substantial coefficient of thermal expansion between ambient temperature and the predetermined operating temperature so that said coil means substantially expands as the temperature of said coil means is raised by the flow of waste gas through said vent pipe and substantially contracts as the temperature of said coil is subsequently reduced, the expansions and contractions of said coil causing separation of sediment from the interior thereof which sediment is carried through said coil by fluid flowing therethrough, said coil means having a water inlet end and a steam outlet end, the water inlet end being disposed below the level of the steam outlet end, solenoid means connected to the inlet end of said coil means for controlling the flow of water into said coil means, and a humidistat operatively connected to said solenoid means for controlling said solenoid means and the injection of water into said coil means such that said hot water gases vaporize the water into steam, and an override control mechanism for preventing the actuation of said solenoid means and the flow of water into said coil means when the gas burners within said furnace are turned off.

5. The humidifier according to claim 4 and further comprising:

means for actuating said solenoid means to permit the flow of water through said coil means for a predetermined time after the burners have been cut off to cool said coils and to flush sediment therefrom.

* * * * *

UNITED STATES PATENT AND TRADEMARK OFFICE

CERTIFICATE OF CORRECTION

PATENT NO. : 4,054,122

DATED : October 18, 1977

INVENTOR(S) : Hugh T. Reed

It is certified that error appears in the above-identified patent and that said Letters Patent are hereby corrected as shown below:

Column 5, lines 14 & 15, after "sediment" insert --separation--.
line 37, after "sediment" insert --separation--.
Column 6, line 11, change "flowig" to --flowing--.
line 20, after "steam" insert --is--.
line 36, change "the" to --The--.
Column 7, line 53, after "automatically" insert --reducing the quantity of liquid therein to a predetermined lower level.--

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*